US009422935B2

(12) United States Patent
Nowitzky et al.

(10) Patent No.: US 9,422,935 B2
(45) Date of Patent: Aug. 23, 2016

(54) FEED UNIT

(71) Applicant: Robert Bosch GmbH, Stuttgart (DE)

(72) Inventors: Ingo Nowitzky, Schwieberdingen (DE); Dieter Amesoeder, Ludwigsburg (DE); Oliver Laforsch, Stuttgart (DE); Sando Kunath, Stuttgart (DE); Evgenij Skrynski, Stuttgart (DE); Marian Kacmar, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 229 days.

(21) Appl. No.: 14/352,888

(22) PCT Filed: Oct. 16, 2012

(86) PCT No.: PCT/EP2012/070507

§ 371 (c)(1),
(2) Date: Apr. 18, 2014

(87) PCT Pub. No.: WO2013/057112

PCT Pub. Date: Apr. 25, 2013

(65) Prior Publication Data

US 2014/0308151 A1 Oct. 16, 2014

(30) Foreign Application Priority Data

Oct. 19, 2011 (DE) ..... 10 2011 084 828

(51) Int. Cl.
*F01C 1/24* (2006.01)
*F04C 18/08* (2006.01)
(Continued)

(52) U.S. Cl.
CPC ..... *F04C 18/084* (2013.01); *F04C 2/084* (2013.01); *F04C 3/08* (2013.01); *F04C 15/06* (2013.01)

(58) Field of Classification Search
CPC ..... F01C 18/084; F04C 18/16; F04C 18/126; F04C 2/084; F04C 18/123; F04C 18/14
USPC ..... 418/194, 205, 9, 166, 171, 191, 201.3, 418/204, 206.5, 75, 77, 79, 80
See application file for complete search history.

(56) References Cited

U.S. PATENT DOCUMENTS 3,856,440 A * 12/1974 Wildhaber ..... B23F 15/08 418/195
5,513,969 A * 5/1996 Arnold ..... F01C 3/085 418/19

(Continued)

FOREIGN PATENT DOCUMENTS

CN 1267355 9/2000
CN 101443554 5/2009

(Continued)

OTHER PUBLICATIONS

International Search Report for Application No. PCT/EP2012/070507 dated Jan. 27, 2014 (English Translation, 2 pages).

*Primary Examiner* — Patrick Maines
(74) *Attorney, Agent, or Firm* — Michael Best & Friedrich LLP

(57) ABSTRACT

A feed unit comprising a first toothing part (1) and a second toothing part (2) which interact with one another via a toothing system (1.1, 2.1) and axes (1.2, 2.2) of which are set obliquely with respect to one another, the first toothing part (1) engaging around the second toothing part (2) with a collar section (8), and working spaces (3) being formed between the toothing system (1.1) of the first toothing part (1) and the toothing system (2.1) of the second toothing part (2), which working spaces (3) are configured to be filled via an inflow (4) and are configured to be emptied via an outflow (5).

18 Claims, 4 Drawing Sheets

(51) Int. Cl.

| | |
|---|---|
| ***F04C 3/08*** | (2006.01) |
| ***F04C 2/08*** | (2006.01) |
| ***F04C 15/06*** | (2006.01) |

(56) References Cited

U.S. PATENT DOCUMENTS

| | | | | |
|---|---|---|---|---|
| 2007/0253851 | A1 | 11/2007 | Arnold | |
| 2010/0233000 | A1* | 9/2010 | Arnold | F01C 21/005 418/21 |
| 2013/0089455 | A1* | 4/2013 | Kacmar | F04C 3/08 418/195 |
| 2013/0189142 | A1* | 7/2013 | Skrynski | F04C 3/08 418/49 |

FOREIGN PATENT DOCUMENTS

| | | | | |
|---|---|---|---|---|
| CN | 101960089 | | 1/2011 | |
| DE | 102008013991 | * | 12/2008 | F01C 1/084 |
| DE | 102010063517 | * | 4/2012 | F16H 39/06 |
| EP | 2119869 | | 11/2009 | |
| GB | 2442478 | | 4/2008 | |

* cited by examiner

FEED UNIT

BACKGROUND OF THE INVENTION

The invention proceeds from a feed unit according to the generic type. DE 102008013991 A1 has already disclosed a feed unit, having a first toothing part and a second toothing part which interact with one another in each case via a toothing system and the axes of which are set obliquely with respect to one another, the first toothing part engaging around the second toothing part with a collar section, and the working spaces being formed between the toothing system of the first toothing part and the toothing system of the second toothing part, which working spaces can be filled via an inflow and can be emptied via an outflow. The control of the inflow and outflow can take place via valves or disk cams.

SUMMARY OF THE INVENTION

The feed unit according to the invention has the advantage, in contrast, that alternative filling and emptying is achieved by the collar section of the first toothing part having at least one first recess for filling or emptying the respective working space, the second toothing part having, on its circumference which faces the first toothing part, at least one second recess which opens into one of the working spaces, the first recess and the second recess forming a flow connection into the respective working space in the case of mutual overlapping.

According to one advantageous embodiment, the second recess of the second toothing part is provided as a groove-shaped depression or as a channel.

The second toothing part has a spherical section and the first toothing part has a hollow spherical section for support on the spherical section, or vice versa.

According to a first exemplary embodiment, the second toothing part has at least one connecting channel which, as viewed in the axial direction, runs, starting from the side which faces away from the spherical section, as far as the spherical section, control grooves being provided on the hollow spherical section of the first toothing part, which control grooves form a flow connection into the respective working space in the case of an overlap with the at least one connecting channel.

According to a second exemplary embodiment, the first toothing part has at least one connecting channel which, as viewed in the axial direction, runs, starting from the side which faces away from the hollow spherical section, as far as the hollow spherical section, control grooves being provided on the spherical section of the second toothing part, which control grooves form a flow connection into the respective working space in the case of an overlap with the at least one connecting channel of the first toothing part. In the second exemplary embodiment, the connecting channel can be divided in a star-shaped or radial manner into a plurality of connecting grooves at its end which faces the control grooves, which connecting grooves then overlap with the control grooves in the case of a corresponding position. This has the advantage that the connecting channel is automatically open in the filling phase and is automatically closed in the emptying phase. The filling and emptying phases are swapped in the case of a reverse rotational direction. No additional valves or control elements are necessary.

According to one advantageous embodiment, the control grooves are of finger-shaped, kidney-shaped, boomerang-shaped, helical, L-shaped, S-shaped, V-shaped or star-shaped configuration in the direction of their longitudinal extent.

According to a third exemplary embodiment, the second toothing part has in each case one control channel between two tooth tips as viewed in the circumferential direction, which control channel leads from the side which faces the working space to the side which faces away from the working space, each control channel being assigned a valve element which can open or close the control channel. This has the advantage that opening is carried out at a pressure which is defined by the valve element for different operating states. As a result, pulsation on the emptying side of the feed unit can be reduced.

BRIEF DESCRIPTION OF THE DRAWINGS

Three exemplary embodiments of the invention are shown in simplified form in the drawing and explained in greater detail in the following description. In the drawing.

DETAILED DESCRIPTION

Figure 1:
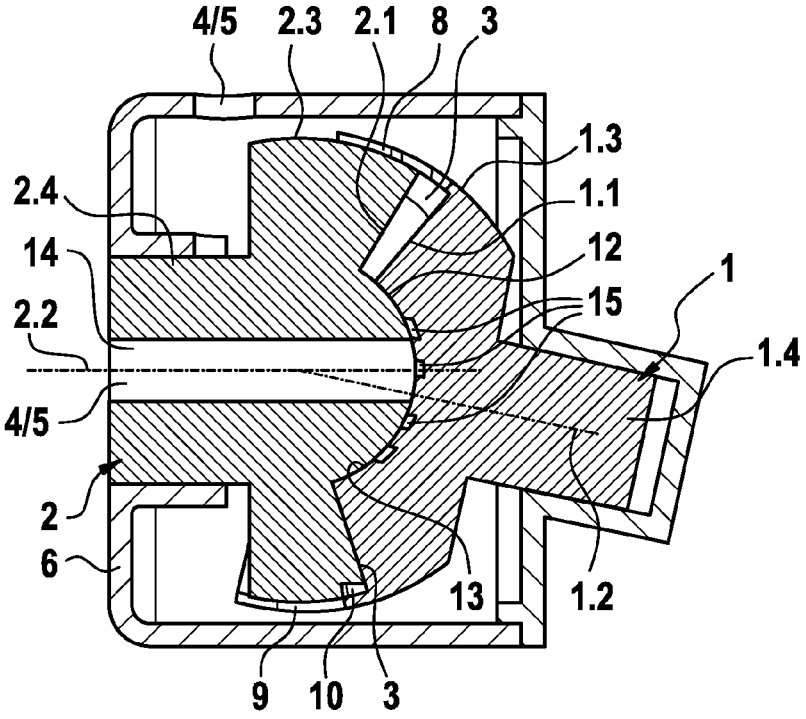
FIG. 1 shows a first exemplary embodiment of the feed unit according to the invention in section.
Figure 2:
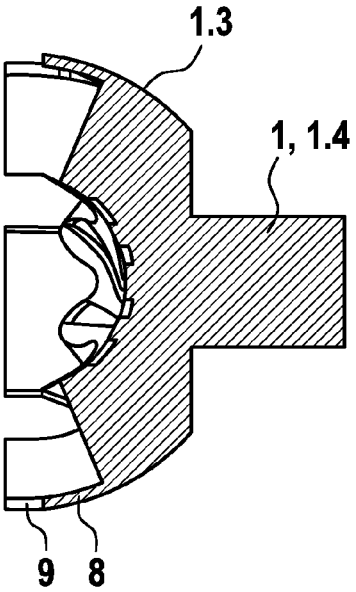
FIG. 2 shows a first toothing part in accordance with the first exemplary embodiment according to FIG. 1 in section.
Figure 3:
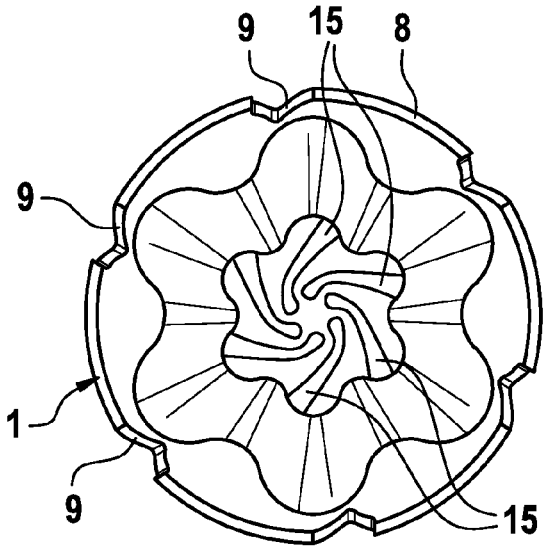
FIG. 3 shows a side view of the first toothing part according to FIG. 2.
Figure 4:
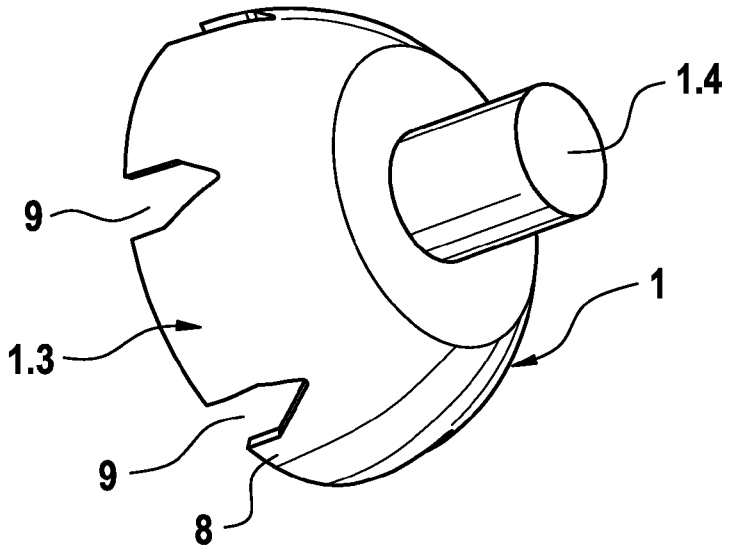
FIG. 4 shows a three-dimensional view of the first toothing part according to FIG. 2.
Figure 5:
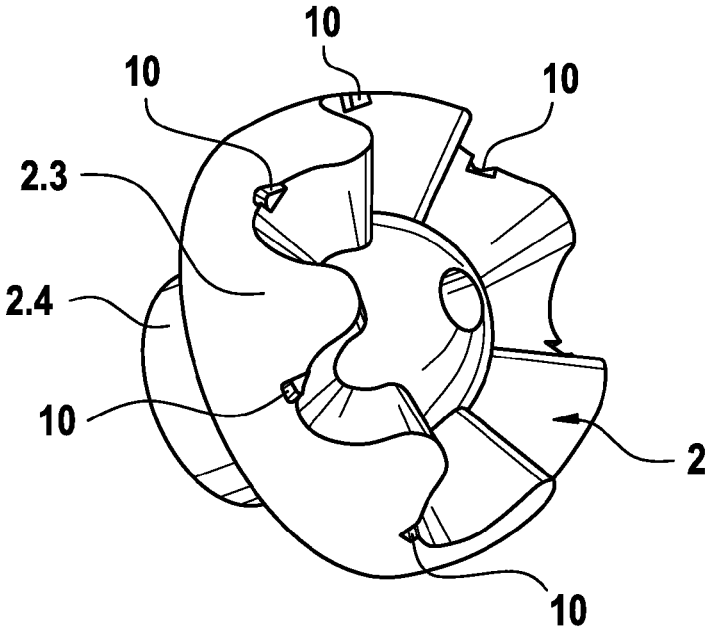
FIG. 5 shows a three-dimensional view of a second toothing part in accordance with the first exemplary embodiment according to FIG. 1.

FIG. 1 shows a first exemplary embodiment of the feed unit according to the invention in section. FIG. 2 to FIG. 5 show individual views of the two toothing parts from FIG. 1.

The feed unit according to the invention can be a pump or a compressor.

The feed unit has a first toothing part 1 and a second toothing part 2 which interact with one another in each case via a toothing system 1.1, 2.1 and the rotational axes 1.2, 2.2 of which are set obliquely with respect to one another, that is to say are not aligned with one another. According to the first exemplary embodiment, the two toothing parts 1, 2 are configured as rotors and are mounted rotatably in a housing 6. One of the rotors 1, 2 is driven by a drive shaft (not shown). The toothing system 1.1, 2.1 of the two toothing parts 1, 2 is provided in each case on the end sides which face one another and is configured, for example, as a cycloidal toothing system. However, another toothing system can also expressly be provided. Working spaces 3 which can be filled via an inflow 4 and can be emptied via an outflow 5 are formed between the toothing system 1.1 of the first toothing part 1 and the toothing system 2.1 of the second toothing part 2. The first toothing part 1 has a collar section 8, with which the second toothing part 2 is engaged around or enclosed at least partially on its circumference. The collar section 8 has the function of separating the working spaces 3 from the interior of the housing 6.

In the first exemplary embodiment, the 2 toothing parts 1, 2 are of spherical or spherical section configuration on their circumference 1.3, 2.3 which has the toothing system, including the collar section 8 of the first toothing part 1. On the end side which faces away from the toothing system 1.1, 2.1, the two toothing parts 1, 2 have, for example, in each case one pin 1.4, 2.4 which is arranged in each case in a bearing of the housing 6.

It is provided according to the invention that the collar section 8 of the first toothing part 1 has at least one first recess 9 for filling or emptying the respective working space 3, the second toothing part 2 having, on its circumference which faces the first toothing part 1, at least one second recess 10 which opens into one of the working spaces 3, the first recess 9 and the second recess 10 forming a flow connection into the respective working space 3 in the case of mutual overlapping. Said flow connection can serve for filling or for emptying.

According to the first exemplary embodiment, a plurality of first recesses 9 are provided on the collar section 8 of the first toothing part 1 and are distributed, for example, at an identical spacing over the circumference. The first recesses 9 are, for example, of slot-shaped, U-shaped or V-shaped configuration, but can also have a different shape. The number of first recesses 9 preferably corresponds to the number of teeth in the toothing part 1. The number of second recesses 10 preferably corresponds to the number of teeth in the toothing part 2.

The working spaces 3 could also be filled or emptied only via the first recess 9, that is to say without the second recess 10, since the first recesses 9 are arranged in such a way that they overlap with the working spaces 3 even without the second recesses 10. However, a greater flow cross section into the working spaces 3 is produced by way of the second recess 10 on the second toothing part 2, with the result that the working spaces 3 can be filled and/or emptied more rapidly.

According to the first exemplary embodiment, the second recesses 10 are provided on the second toothing part 2 in each case between the tooth tips of the toothing system 2.1 as viewed in the circumferential direction. For example, there is a second recess 10 in each tooth gap which is formed between two teeth. According to the first exemplary embodiment, the second recesses 10 of the second toothing part 2 are configured as a groove-shaped depression or as a channel.

The second toothing part 2 has, for example, a central spherical section 12 and the first toothing part 1 has a central hollow spherical section 13 for support on the central spherical section 12, or vice versa. The toothing system 1.1, 2.1 is provided in each case around the spherical section 12 and the hollow spherical section 13. According to the first exemplary embodiment, the second toothing part 2 has at least one connecting channel 14 which, as viewed in the axial direction, runs, starting from the side which faces away from the spherical section 12, as far as the spherical section 12. Control grooves 15 are configured on the hollow spherical section 13 of the first toothing part 1, which control grooves 15 form a flow connection into the respective working space 3 in the case of overlapping with the at least one connecting channel 14 of the second toothing part 2. The control grooves 15 are, for example, of finger-shaped, kidney-shaped, boomerang-shaped, helical, L-shaped, S-shaped, V-shaped or star-shaped configuration in the direction of their longitudinal extent, but can also expressly have a different shape.

According to the first exemplary embodiment, in the case of a corresponding flow connection (overlap), the delivery medium flows via the connecting channel 14 and at least one of the control grooves 15 into one of the working spaces 3 and, after the pressure build-up in the working space 3, in the case of a corresponding flow connection (overlap), via the 2 recesses 9, 10 out of said working space 3 again. It goes without saying that the reverse flow direction via the two recesses 9, 10 into the corresponding working space 3 and, after a pressure build-up, via at least one control groove 15 and the connecting channel 14 out of the working space 3 is likewise possible.

Figure 6:
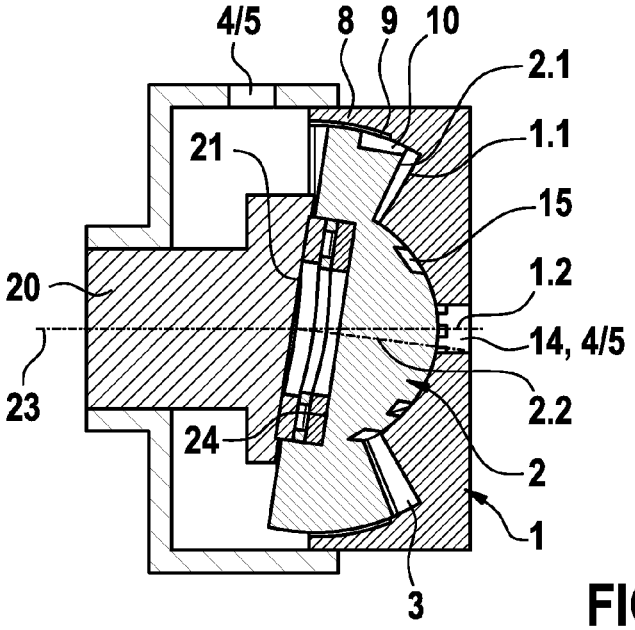
FIG. 6 shows a second exemplary embodiment of the feed unit according to the invention in section.
Figure 7:
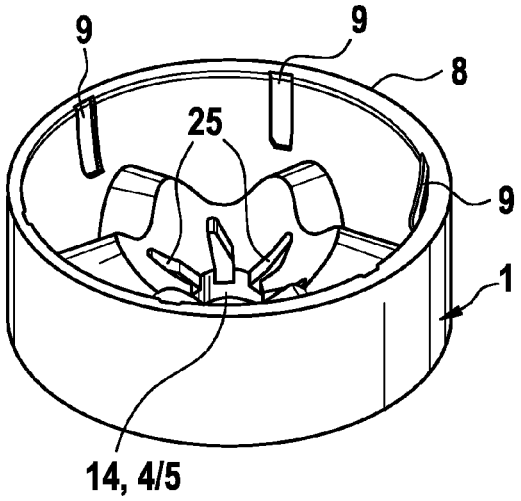
FIG. 7 shows a first toothing part in accordance with the second exemplary embodiment according to FIG. 6.
Figure 8:
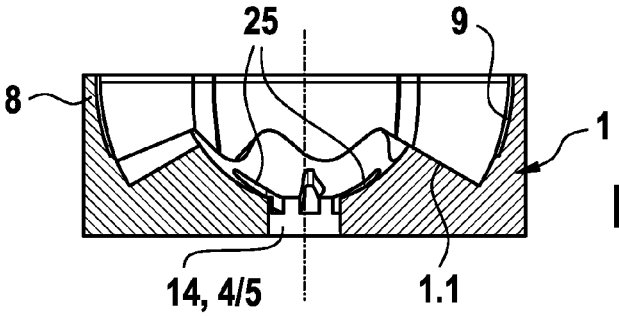
FIG. 8 shows the first toothing part according to FIG. 7 in section.
Figure 9:
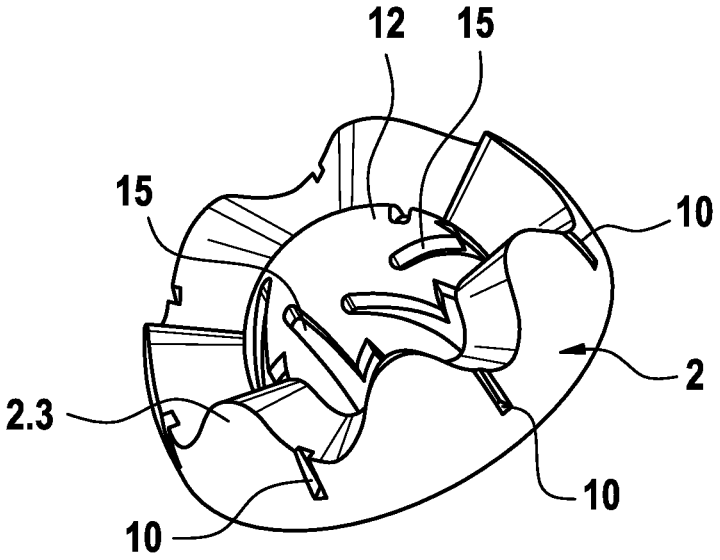
FIG. 9 shows a three-dimensional view of a second toothing part in accordance with the second exemplary embodiment according to FIG. 6.

FIG. 6 shows a second exemplary embodiment of the feed unit according to the invention in section. In the feed unit according to FIG. 6, the parts which remain the same or have the same action as in the feed unit according to FIG. 1 to FIG. 5 are identified by the same designations.

The second exemplary embodiment according to FIG. 6 to FIG. 9 differs from the first exemplary embodiment in that the first toothing part 1 is a stator and the second toothing part is a rotor.

A drive shaft 20 drives the second toothing part 2 which is arranged rotatably in the first toothing part 1 which is configured as a stator. The drive shaft 2 has an oblique plane 21 which interacts with the second toothing part 2 and on which a roller bearing is arranged. The toothing part 2 which tumbles with its rotational axis 2.2 about the axis 23 of the drive shaft 20 is situated on that side of the roller bearing which faces away from the drive shaft 2. On its side which faces the drive shaft 20, the second toothing part 2 has a face 24 which interacts with the roller bearing and, on its side which faces the toothing system 1.1 of the first toothing part 1, has the toothing system 2.1.

As in the first exemplary embodiment, the first toothing part 1 has a collar section 8 which engages around the second toothing part 2. According to the second exemplary embodiment, the first recesses 9 on the first toothing part 1 are configured as grooves which are arranged on that inner side of the collar section 8 which faces the second toothing part 2. The groove runs, for example, in the axial direction as far as the open end side of the first toothing part 1.

As in the first exemplary embodiment, the first recesses 9 of the first toothing part 1 interact with the second recesses 10 of the second toothing part 2 in such a way that a flow connection into the respective working space 3 is formed in the case of mutual overlapping.

According to the second exemplary embodiment, it is not the second toothing part 2 but rather the first toothing part 1 which has the at least one connecting channel 14 which, as viewed in the axial direction, runs, starting from the side which faces away from the hollow spherical section 13, as far as the hollow spherical section 13. The control grooves 15 are configured on the spherical section 12 of the second toothing part 2, which control grooves 15 form a flow connection into the respective working space 3 in the case of an overlap with the at least one connecting channel 14 of the first toothing part 1. On its end section which faces the spherical section 12, the connecting channel 14 can be divided into connecting grooves 25 or can open into the latter, which connecting grooves 25 allow the flow connection into the respective working space 3 to be produced in the case of an overlap with the control grooves 15 of the first toothing part 1.

According to the second exemplary embodiment, in the case of a corresponding flow connection (overlap), the delivery medium flows via the connecting channel 14, 25 and at least one of the control grooves 15 into one of the working spaces 3 and, after a pressure build-up in the working space 3, in the case of a corresponding flow connection (overlap), flows via the two recesses 9, 10 out of said working space 3 again. It goes without saying that the reverse flow direction via the two recesses 9, 10 into the corresponding working space 3 and, after a pressure build-up, via at least one control groove 15 and the connecting channel 14, 25 out of the working space 3 is likewise possible.

Figure 10:
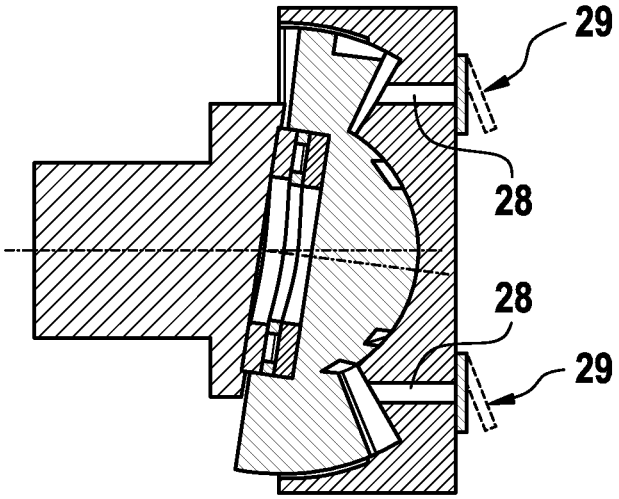
FIG. 10 shows a third exemplary embodiment in section.

FIG. 10 shows a third exemplary embodiment of the feed unit according to the invention in section. In the feed unit according to FIG. 10, the parts which remain the same or have the same action as in the feed unit according to FIG. 6 to FIG. 9 are identified by the same designations.

The third exemplary embodiment according to FIG. 10 differs from the second exemplary embodiment exclusively in that the inflow and outflow on the side of the first toothing part 1 is changed. The inflow and outflow via the two recesses 9, 10 are of identical configuration as in the second exemplary embodiment. The other flow connection into the working spaces 3, which flow connection does not lead via the two recesses 9, 10, does not run via a single connecting channel 14 on the first toothing part 1 and via the control grooves 15 which interact with the single connecting channel 14, but rather each working space 3 has a dedicated, separate control channel 28 as inflow and outflow. The inflow and outflow into the working spaces 3 does not depend, as in the two other exemplary embodiments, on the overlap of the connecting channel 14 and control grooves 15, but rather is controlled by valve elements 29. Each control channel 28 is assigned a valve element 29 which can open or close the control channel 28. The valve elements 29 are configured, for example, as elastic flaps. The valve elements 29 have the function of promoting the throughflow through the control channels 28 in only one direction, either as inflow or as outflow. If valves are arranged on the outflow side, they afford the advantage that opening is carried out at a pressure which is defined by the valve in different operating states. As a result, pulsation on the outflow side of the feed unit can be reduced.

The invention claimed is:

1. A feed unit comprising: a first toothing part (1) and a second toothing part (2) which interact with one another via a toothing system (1.1, 2.1) and axes (1.2, 2.2) of which are set obliquely with respect to one another, the first toothing part (1) engaging around the second toothing part (2) with a collar section (8), and working spaces (3) being formed between the toothing system (1.1) of the first toothing part (1) and the toothing system (2.1) of the second toothing part (2), which working spaces (3) are configured to be filled via an inflow (4) and are configured to be emptied via an outflow (5), wherein the collar section (8) of the first toothing part (1) has at least one first recess (9) for filling or emptying the respective working space (3), the second toothing part (2) having, on a circumference which faces the first toothing part (1), at least one second recess (10) which opens into one of the working spaces (3), the first recess (9) and the second recess (10) forming a flow connection into a respective working space (3) when overlapped.

2. The feed unit as claimed in claim 1, wherein the second recess (10) of the second toothing part (2) is provided between two tooth tips as viewed in a circumferential direction.

3. The feed unit as claimed in claim 1, wherein the second recess (10) of the second toothing part (2) is configured as a groove-shaped depression or as a channel.

4. The feed unit as claimed in claim 1, wherein one of the first toothing part and the second toothing part (2) has a spherical section (12) and the other of the first toothing part (1) and the second toothing part has a hollow spherical section (13) for support on the spherical section (12).

5. The feed unit as claimed in claim 4, wherein the second toothing part (2) has at least one connecting channel (14) which, as viewed in an axial direction, runs, starting from a side which faces away from the spherical section (12), as far as the spherical section (12), control grooves (15) being provided on the hollow spherical section (13) of the first toothing part (1), which control grooves (15) form a flow connection into the respective working space (3) via an overlap with the at least one connecting channel (14) of the second toothing part (2).

6. The feed unit as claimed in claim 4, wherein the first toothing part (1) has at least one connecting channel (14) which, as viewed in an axial direction, runs, starting from a side which faces away from the hollow spherical section (13), as far as the hollow spherical section (13), control grooves (15) being provided on the spherical section (12) of the second toothing part (2), which control grooves (15) form a flow connection into the respective working space (3) via an overlap with the at least one connecting channel (14) of the first toothing part (1).

7. The feed unit as claimed in claim 5, wherein the control grooves (15) are of finger-shaped, kidney-shaped, boomerang-shaped, helical, L-shaped, S-shaped, V-shaped or star-shaped configuration in a direction of their longitudinal extent.

8. The feed unit as claimed in claim 1, wherein the second toothing part (2) has one control channel (28) between two tooth tips as viewed in a circumferential direction, which control channel (28) leads from a side which faces the working space (3) to a side which faces away from the working space (3), each control channel (28) being assigned a valve element (29) which can open or close the control channel (28).

9. The feed unit as claimed in claim 1, wherein the first toothing part (1) is a rotor and the second toothing part (2) is a counter-rotor or a stator.

10. The feed unit as claimed in claim 1, wherein the feed unit is a pump or a compressor.

11. The feed unit as claimed in claim 2, wherein the second recess (10) of the second toothing part (2) is configured as a groove-shaped depression or as a channel.

12. The feed unit as claimed in claim 11, wherein one of the first toothing part and the second toothing part (2) has a spherical section (12) and the other of the first toothing part (1) and the second toothing part has a hollow spherical section (13) for support on the spherical section (12).

13. The feed unit as claimed in claim 12, wherein the second toothing part (2) has at least one connecting channel (14) which, as viewed in an axial direction, runs, starting from a side which faces away from the spherical section (12), as far as the spherical section (12), control grooves (15) being provided on the hollow spherical section (13) of the first toothing part (1), which control grooves (15) form a flow connection into the respective working space (3) in the case of an overlap with the at least one connecting channel (14) of the second toothing part (2).

14. The feed unit as claimed in claim 12, wherein the first toothing part (1) has at least one connecting channel (14) which, as viewed in an axial direction, runs, starting from a side which faces away from the hollow spherical section (13), as far as the hollow spherical section (13), control grooves (15) being provided on the spherical section (12) of the second toothing part (2), which control grooves (15) form a flow connection into the respective working space (3) in the case of an overlap with the at least one connecting channel (14) of the first toothing part (1).

15. The feed unit as claimed in claim 14, wherein the control grooves (15) are of finger-shaped, kidney-shaped, boomerang-shaped, helical, L-shaped, S-shaped, V-shaped or star-shaped configuration in a direction of their longitudinal extent.

16. The feed unit as claimed in claim 15, wherein the second toothing part (2) has one control channel (28) between two tooth tips as viewed in a circumferential direction, which control channel (28) leads from a side which faces the working space (3) to a side which faces away from the working space (3), each control channel (28) being assigned a valve element (29) which can open or close the control channel (28).

17. The feed unit as claimed in claim 16, wherein the first toothing part (1) is a rotor and the second toothing part (2) is a counter-rotor or a stator.

18. The feed unit as claimed in claim 17, wherein the feed unit is a pump or a compressor.

* * * * *